US009109461B2

(12) United States Patent
Takahashi et al.

(10) Patent No.: US 9,109,461 B2
(45) Date of Patent: Aug. 18, 2015

(54) AXIAL FLOW COMPRESSOR, GAS TURBINE SYSTEM HAVING THE AXIAL FLOW COMPRESSOR AND METHOD OF MODIFYING THE AXIAL FLOW COMPRESSOR

(75) Inventors: Yasuo Takahashi, Mito (JP); Chihiro Myoren, Naka-gun (JP); Ryou Akiyama, Hitachinaka (JP); Ichiro Miyoshi, Mito (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 786 days.

(21) Appl. No.: 13/197,947

(22) Filed: Aug. 4, 2011

(65) Prior Publication Data

US 2012/0070267 A1 Mar. 22, 2012

(30) Foreign Application Priority Data

Sep. 16, 2010 (JP) ..... 2010-207448

(51) Int. Cl.
*F01D 5/14* (2006.01)
*F01D 25/00* (2006.01)
*F04D 29/54* (2006.01)

(52) U.S. Cl.
CPC ..... *F01D 25/00* (2013.01); *F01D 5/142* (2013.01); *F04D 29/544* (2013.01); *F05D 2230/50* (2013.01); *F05D 2240/10* (2013.01)

(58) Field of Classification Search
CPC ..... F01D 5/141; F01D 5/142; F01D 5/145; F01D 5/143; F01D 5/146; F05D 2240/10; F05D 2240/121; F05D 2240/129; F05D 2240/123; F05D 2240/124; F04D 29/54; F04D 29/544
USPC ..... 415/191–195, 211.2, 144, 168.1; 416/175
See application file for complete search history.

(56) References Cited

U.S. PATENT DOCUMENTS

| | | | | |
|---|---|---|---|---|
| 3,112,866 | A * | 12/1963 | Fortescue | 415/194 |
| 4,719,747 | A * | 1/1988 | Willkop et al. | 60/785 |
| 6,732,530 | B2 * | 5/2004 | Laurello et al. | 60/782 |
| 2008/0107535 | A1 * | 5/2008 | Radhakrishnan et al. | 416/223 A |
| 2010/0092284 | A1 * | 4/2010 | Bonini et al. | 415/208.2 |
| 2010/0303629 | A1 * | 12/2010 | Guemmer | 416/223 R |

FOREIGN PATENT DOCUMENTS

| | | | | |
|---|---|---|---|---|
| JP | 2002-61594 | A | 2/2002 | |
| JP | 2002061594 | A * | 2/2002 | F04D 27/02 |

OTHER PUBLICATIONS

Translation of JP2002061594.*

* cited by examiner

*Primary Examiner* — Dwayne J White
*Assistant Examiner* — William Grigos
(74) *Attorney, Agent, or Firm* — Crowell & Moring LLP

(57) ABSTRACT

There is provided an axial flow compressor that improves reliability on an increase in a blade loading on a last-stage stator vane of the axial flow compressor due to a partial load operation of a gas turbine. An annular flow passage is formed by a rotor having multiple rotor blades fitted thereto and a casing having multiple stator vanes fitted thereto, two or more of the stator vanes are disposed downstream of a last-stage rotor blade that is the rotor blade disposed at the most downstream side in a flow direction of the annular flow passage, a blade loading on a first stator vane disposed at the most upstream side is set to be smaller than a blade loading of a second stator vane disposed downstream of the first stator vane by one row.

9 Claims, 9 Drawing Sheets

AXIAL FLOW COMPRESSOR, GAS TURBINE SYSTEM HAVING THE AXIAL FLOW COMPRESSOR AND METHOD OF MODIFYING THE AXIAL FLOW COMPRESSOR

FIELD OF THE INVENTION

The present invention relates a gas turbine or industrial axial flow compressor, and more particularly to a stator situated on a rear side of the axial flow compressor.

BACKGROUND OF THE INVENTION

FIG. 3 illustrates a schematic diagram of a multistage axial flow compressor. A compressor 1 includes a rotating rotor 22 to which multiple rotor blades 31 is fitted, and a casing 21 to which multiple stator 34 is fitted, and has an annular flow passage formed by the rotating rotor 22 and the casing 21 inside. The rotor blades 31 and the stator vanes 34 are alternately arranged in an axial direction thereof, and each rotor blade and each stator vane configure one stage. An inlet guide vane 33 (IGV) for controlling an inlet flow, rate is disposed upstream of an initial rotor vane row. Also, a last-stage stator vane 35 and exit guide vanes (EGV) 36, 37, which are stator vanes, are disposed downstream of a last-stage rotor blade 32. FIG. 3 illustrates a configuration in which two exit guide vane rows are disposed in the axial direction.

An inlet air of the axial flow compressor is decelerated and compressed by the respective vane rows into a high-temperature and high-pressure airflow while passing through the annular flow passage. A pressure increase (corresponding to a vane row load) of each vane row is determined according to a set angle of the vane row and an operating state. There is a need to ensure an aerodynamic performance and reliability of the vane rows even in the operating state where the vane row load is highest.

Japanese Unexamined Patent Application Publication No. 2002-61594 discloses a load control system for a compressor which controls the respective stator vanes as independent variable vanes, and averages the loads of the respective stages. However, Japanese Unexamined Patent Application Publication No. 2002-61594 fails to disclose a load distribution of the stator vanes situated on a rear stage side of the axial flow compressor.

SUMMARY OF THE INVENTION

For example, when the compressor operates in a state where the IGV is closed, the vane row load on the rear stage side of the compressor increases, and the loads on the last-stage stator vane and the EGV downstream of the last-stage stator vane also increase. Also, when a large amount of compressed air is extracted from an inner extraction slit upstream of the last-stage stator vane, an axial velocity on an inner peripheral side of the last-stage stator vane is reduced to locally increase an angle (inlet flow angle) of a flow to the axial direction. For that reason, there is a possibility that the blade loading on the last-stage stator vane increases.

With an increase in the blade loading, a possibility that the flow is separated from the vane surfaces increases. This separation phenomenon leads to a risk that vane vibration increases, and adversely affects the performance and reliability of the cascade. For that reason, it is important to appropriately set the load on the stator vane disposed on the rear stage side of the compressor from the viewpoints of the reliability and aerodynamic performance of the overall compressor.

Under the above circumstances, an object of the present invention is to provide an axial flow compressor that improves the reliability.

In order to achieve the above object, according to one aspect of the present invention, there is provided an axial flow compressor in which an annular flow passage is formed by a rotor having multiple rotor blades fitted thereto and a casing having multiple stator vanes fitted thereto, two or more of the stator vanes are disposed downstream of a last-stage rotor blade that is the rotor blade disposed at the most downstream side in a flow direction of the annular flow passage, a blade loading on a first stator vane disposed at the most upstream side is set to be smaller than a loading of a second stator vane disposed downstream of the first stator vane by one row.

The present invention can provide the axial flow compressor that improves the reliability.

DETAILED DESCRIPTION OF THE PREFERRED EMBODIMENTS

For example, in the operation of a gas turbine in which a turbine and a compressor are configured by one shaft, there is a method in which the combustion temperature of a gas turbine is held in constant, and an IGV 33 of the compressor is closed to expand an operation range of the gas turbine. Also, in the partial load operation of a two-shaft gas turbine where a turbine side is divided into a high pressure turbine and a low pressure turbine, and rotating shafts thereof are configured by different shafts, in order to balance an output of the high pressure turbine with a compressor power, operation is required in a state where the IGV 33 of the compressor is closed more than the normal. In this operation, there is a possibility that the vane row load on the rear stage side of the compressor increases, and the flow is separated from the vane surfaces. For that reason, there is a risk that the reliability and aerodynamic performance are deteriorated.

Figure 2:
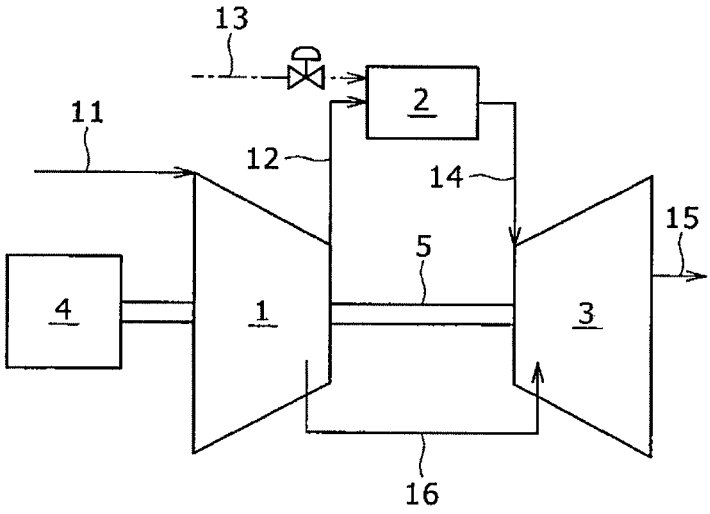
FIG. 2 is a schematic system diagram of a gas turbine according to one embodiment of the present invention.

FIG. 2 is a schematic diagram of a gas turbine system according to one embodiment of the present invention. Hereinafter, a configuration of the gas turbine system will be described with reference to FIG. 2.

Figure 10:
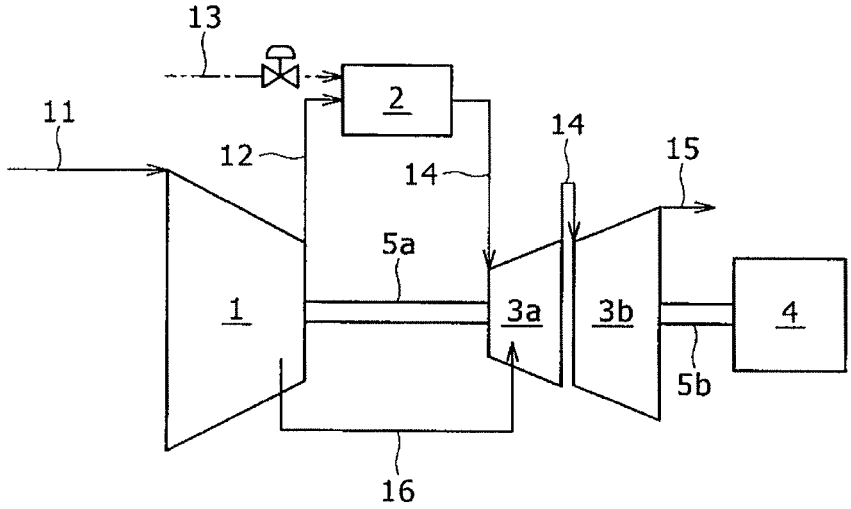
FIG. 10 is a schematic system diagram of a two-shaft gas turbine according to the embodiment of the present invention.

The gas turbine system illustrated in FIG. 2 includes a compressor 1 that compresses air 11 to generate a compressed air 12, a combustor 2 that mixes the compressed air 12 with a fuel 13 to burn an air-fuel mixture, and a turbine 3 rotatably driven by a high-temperature combustion gas. The compressor 1 and the turbine 3 are connected to a power generator 4 that is a load device through a rotating shaft 5. In the description, a gas turbine is assumed. However, the same is applied to a two-shaft gas turbine in which a turbine side is configured by different shafts of a high pressure turbine 3*a* and a low pressure turbine 3*b* as illustrated in FIG. 10.

Subsequently, a flow of working fluid will be described. The air 11, which is the working fluid, flows into the compressor 1 and is compressed by the compressor 1. Thereafter, the air 11 flows into the combustor 2. The compressed air 12 is mixed with the fuel 13 and burned, by the combustor 2 to generate a high-temperature combustion gas 14. After the combustion gas 14 turns the turbine 3, the combustion gas 14 is discharged to an external of the system as an exhaust gas 15. The power generator 4 is driven by a rotating power of the turbine which is transmitted through the rotating shaft 5 that communicates the compressor 1 with the turbine 3.

A part of the compressed air is extracted from a rear stage of the compressor 1 as a turbine rotor cooling air 16 (and sealing air), and supplied to the turbine side through an inner peripheral flow passage of the gas turbine. The cooling air 16 is guided to a high-temperature combustion gas flow passage of the turbine while cooling the turbine rotor. The cooling air 16 also suppresses a leakage of the high-temperature gas from the high-temperature combustion gas flow passage of the turbine to an interior of the turbine rotor, and serves as a sealing air.

Figure 3:
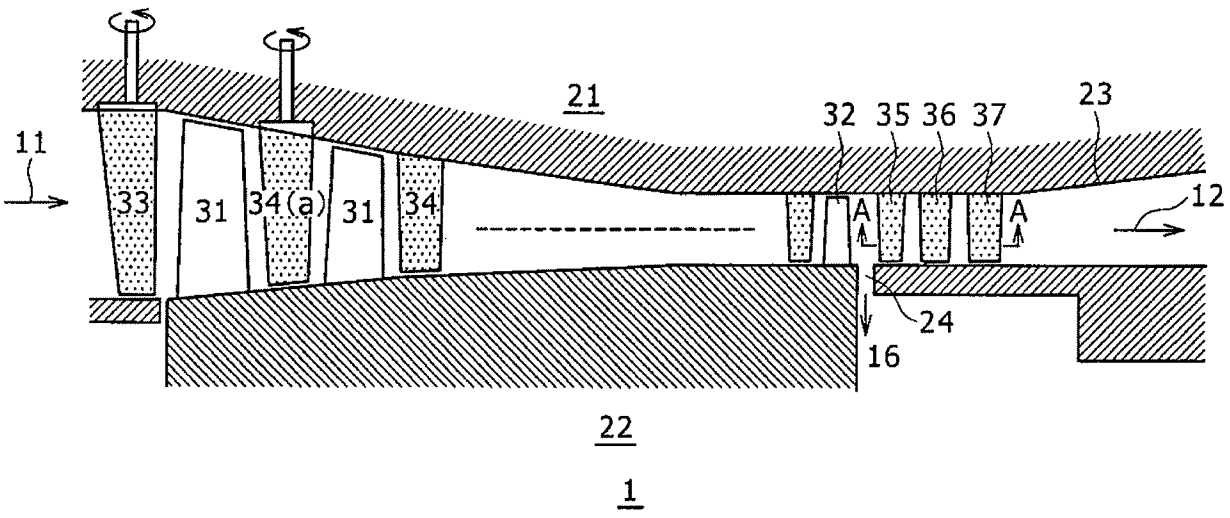
FIG. 3 is a meridional cross-sectional view of an axial flow compressor.

Subsequently, an internal structure of the compressor will be described with reference to FIG. 3. The compressor 1 includes a rotating rotor 22 having multiple rotor blades 31 fitted thereto, and a casing 21 having multiple stator vanes 34 fitted thereto, and has an annular flow passage formed by the rotating rotor 22 and the casing 21 inside. The rotor blades 31 and the stator vanes 34 are alternately arranged in an axial direction thereof, and each rotor blade and each stator vane configure one stage. An inlet guide vane (IGV) 33 for controlling an inlet flow rate is disposed upstream of the rotor blades 31. Also, the front-stage stator vane has a variable stator vane for suppressing rotating stall at start-up of the gas turbine. In FIG. 3, only the stator vanes IGV 33 and 34 each have the variable stator vane. Alternatively, the variable stator vanes may be further disposed in multi stages.

The stator vanes of the last-stage stator vane 35 and the exit guide vanes (EGV) 36, 37 are disposed in three cascades in the order from the upstream, downstream of the last-stage rotor blade 32 which is a rotor blade disposed at the most downstream side in the flow direction of the annular flow passage. The EGV is the stator vane installed for the purpose of converting a rotating velocity component supplied to the working fluid by the rotor blade within the annular flow passage into an axial velocity component. A diffuser 23 is equipped downstream of the compressor in order to decelerate the compressed air 12 emitted from the EGV 37 and introduce the air into the combustor. FIG. 3 illustrates a case in which the exit guide vanes are configured in two stages in the axial direction. However, the EGV may be one or more cascades. Also, an inner extraction slit 24 is disposed in inner peripheries of the downstream side of the last-stage rotor blade 32 and the upstream side of the last-stage stator vane 35 for extracting the turbine rotor cooling air 16.

The air 11 flowing into the annular flow passage of the compressor is increased in kinetic energy of fluid due to rotation of the rotor blades, decelerated by the stator vanes, and stepped up by conversion from the kinetic energy to the pressure energy. Because the working air is subjected to rotating speed by the rotor blade, an air into the last-stage stator vane 35 of the compressor flows at an inlet flow angle of about 50 to 60 deg to the axial direction. On the other hand, in order to improve the aerodynamic performance, it is desirable that the flow flowing into the diffuser 23 situated at a compressor exist is at the inlet flow angle of zero (only the axial velocity component). That is, it is important to convert the flow from about 60 deg to 0 deg by the stator vanes including the last-stage stator vane 35 and the exit guide vanes 36, 37 for improving the aerodynamic performance.

Figure 4:
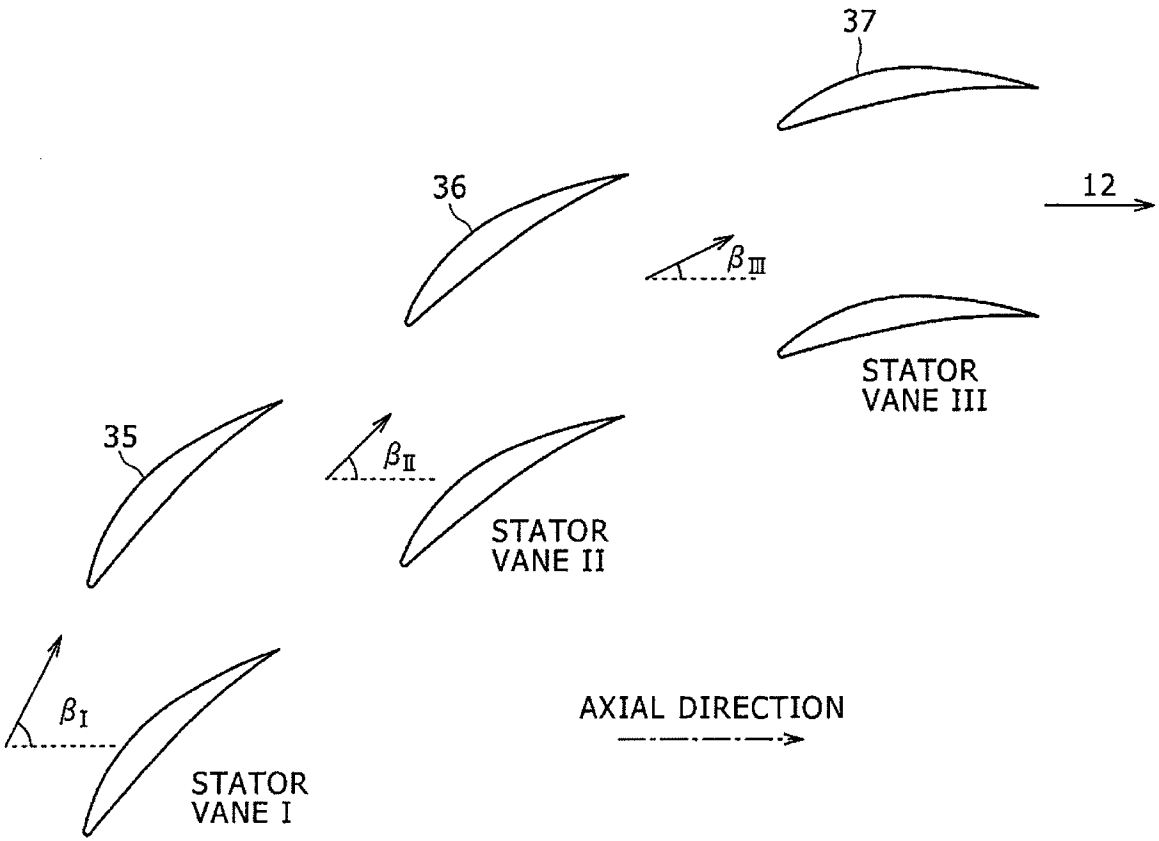
FIG. 4 is a schematic system diagram of a rear-stage stator vane in the axial flow compressor in a span direction.

A flow field of a stator vane cross section indicated by a section A-A in FIG. 3 will be described with reference to FIG. 4. For simplification, in the following description, the last-stage stator vane 35 that is a first stator vane is called "stator vane I", the EGV 36 that is a second stator vane is called "stator vane II", and the EGV 37 that is a third stator vane is called "stator vane III". In each of the stator vane I to the stator vane III, multiple vanes is fitted to the casing with given pitch lengths in the circumferential direction. In the figure, only two vane rows are shown in a cross section along a given span direction, and the other vanes are omitted.

The flow flowing at an inlet flow angle $\beta_I$ to the stator vane I is turned at the stator vane I, and flows out at an outlet flow angle $\beta_{II}$. The outflow is introduced into the stator vane II at the inlet flow angle $\beta_{II}$. The flow is also turned at the stator vane II, and is introduced into the stator vane III at the outlet flow angle $\beta_{III}$ of the stator vane II. The flow is turned in the axial direction by the stator vane III, and finally introduced into the diffuser by the axial velocity component.

In the above flow field, a load on the stator vanes is defined by a turning angle that is a difference between the inlet flow angle and the outflow angle. That is, as the turning angle is larger, the blade loading is more increased, and a loss occurring on the vane rows is also larger. On the contrary, as the turning angle is smaller, the blade loading is less increased, and a loss occurring on the vane rows is also smaller. The overall turning angle from the stator vane I to the stator vane III is determined according to the outlet flow angle of the last-stage rotor blade 32 since the outlet flow angle of the last-state stator vane is different according to the operating state of the compressor. In order to perform the higher performance of the compressor, it is important to appropriately set the load distribution from the stator vane I to the stator vane III.

Figure 1A:
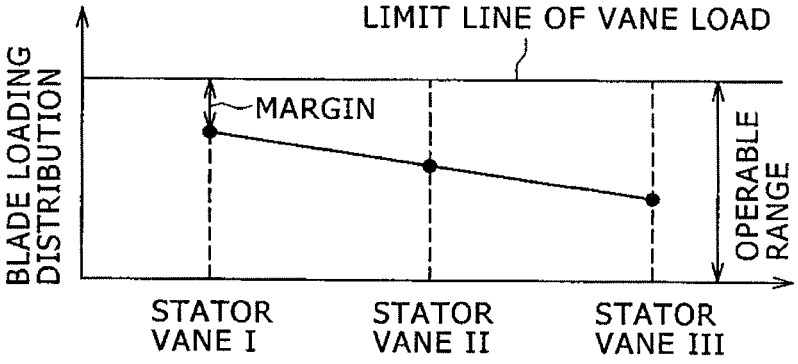
FIG. 1A is a distribution diagram of a loading of a general rear-stage stator vane.
Figure 5:
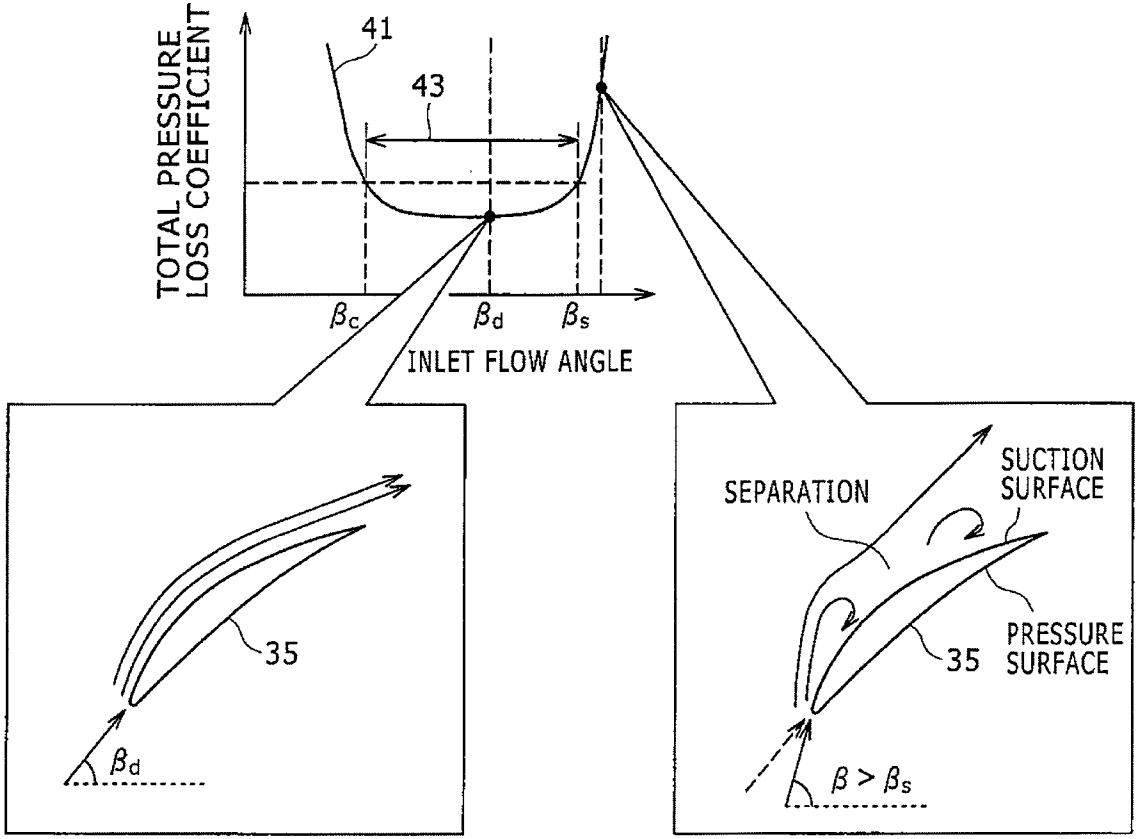
FIG. 5 is a cross-sectional view of the last-stage stator vane in the span direction, and a diagram of an inlet flow angle to total pressure loss characteristic corresponding to the cross-sectional view.

The load distribution from the stator vane I to the stator vane III when the higher efficiency of the compressor is prioritized is illustrated in FIG. 1A. In FIG. 1A, the load is set to be largest in the stator vane I, and the load is sequentially decreased toward the downstream side, that is, the stator vanes II and III. Also, because the outlet flow angle from the stator vane III is turned in the axil direction, the stagger angle of the vane row (tilt angle of the vane cord length from the axial direction) is larger in the stator vane row, and smaller in the stator vane III. As the stagger angle of the vane row such as the stator vane II and the stator vane III is smaller, separation of the flow on a negative surface side of the vane row is more liable to occur as illustrated in FIG. 5.

When the separation occurs, the reliability and the aerodynamic performance of the vane rows are deteriorated due to the fluid excitation. In particular, when the separation occurs on the stator vane at the downstream side, there is a risk that the performance is further deteriorated because the separated flow flows into the diffuser. Accordingly, in order to perform the higher efficiency of the compressor, it is conceivable that the load distribution illustrated in FIG. 1A is preferable in which the turning angle is more reduced toward the stator vane II and the stator vane III, and the blade loading can be more reduced to suppress the separation.

Subsequently, the operating state of the compressor will be described with reference to an example using a gas turbine system.

The gas turbine is required to ensure the performance and reliability not only during a rated operation but also at the time of start and when a partial load is applied. To enlarge an operational load region of the gas turbine with an improvement in the partial load characteristic of the gas turbine is largely advantageous in the operation when so much electric power is not required, for example, during the night. In a gas turbine in which the turbine and the compressor are configured by the same shaft, there is a method in which, in order to enlarge the operational load region, a compressor inlet flow rate is changed by opening or closing an IGV opening in a state where a combustion temperature is held at a rated temperature, and the gas turbine output is controlled.

In the above operation, when the IGV 33 is closed, the velocity component in the axial direction of the flow becomes smaller toward the downstream side, and a ratio of the velocity component in the circumferential direction becomes higher. For that reason, the inlet flow angle to the stator vane is increased, and the load on the rear-stage vane row of the compressor is increased. In particular, the fluctuation of the inlet flow angle is remarkable in the stator vane I where the outlet flow angle of the last-stage rotor blade becomes the inlet flow angle, and an increase in the load is worried about. Also, when an atmospheric temperature is low, an increase in the load on the rear-stage vane row during the partial load operation becomes further remarkable. There is no margin of an upper limit of the blade loading, and when the blade loading reaches a limit line, the vane row is subjected to fluid excitation due to, the separation. When the vane row vibration stress becomes equal to or larger than a permissible stress value, a possibility that the vane rows are damaged becomes high.

As illustrated in FIG. 3, when there are plural stages of vane rows each having a variable stator vane at the compressor front stage side, because a variable stator vane 34(*a*) is normally also opened and closed in association with the IGV 33, the variable stator vane 34(*a*) is also closed during the partial load operation where the IGV 33 is closed. Accordingly, at a stage where the variable stator vane 34(*a*) is provided, the stage work is reduced, and the load is reduced. However, because the pressure ratio per se of the entire compressor is not changed, the load on the rear-stage vane row is further increased according to a reduction of the blade loading at the front stage side. Because a side wall boundary layer develops at the rear stage side of the annular flow passage, the axial velocity is decreased in the side wall portion, and due to this influence, the inlet flow angle is increased in the side wall portion of the stator vane, and the load is increased as compared with that in the main flow portion. As a result, at the side wall part of the rear-stage vane row, the separation is more liable to occur than that on the front-stage vane row.

In the partial load operation of the bidirectional gas turbine where the turbine is configured by different shafts of a high pressure turbine 3*a* and a low pressure turbine 3*b*, in order to balance an output of the high pressure turbine 3*a* with the compressor power, there is a need that the IGV 33 is closed to reduce the inlet flow rate and reduce the compressor power, and a pressure ratio is set to be higher to increase the output in the high pressure turbine 3*a*. In such operation were the IGV 33 and the variable stator vane 34(*a*) are closed, because the load on the vane row at the compressor rear-stage side is increased, there arises a problem that the reliability and performance of the vane row are ensured.

Also, in the gas turbine system to improve the output and efficiency of the gas turbine by conducting a large amount of water spray at the inlet of the compressor, there is a tendency that the cascade load at the front stage side of the compressor is decreased, and the cascade load at the rear-stage side is increased. Also, in the gas turbine system where the output and efficiency of the gas turbine are improved with the help of a large amount of water spray at the inlet of the compressor, the cascade load at the front stage side of the compressor is decreased, and the cascade load at the rear stage side is increased. At the front stage side of the compressor, the effect of increasing the flow rate of the working fluid by evaporating moisture is larger than the effect of increasing corrected speed caused by a temperature decrease of the working fluid. As a result, the velocity component in the axial direction is increased more than that before the water spray. Accordingly, an increase in the inlet flow angle to the stator vane is suppressed, and an increase in the load is suppressed. On the other hand, since the pressure ratio per se of the entire compressor is not changed, a load reduction of the front stage cascade is compensated by the load increase of the rear stage cascade. Also, at the rear stage cascade, the effect of increasing corrected speed caused by a temperature decrease of the working fluid is larger than the effect of increasing the flow rate of the working fluid by evaporating moisture. As a result, the inlet flow angle of the rear stage cascade is increased to increase the blade loading. Accordingly, as in the operation where the IGV is closed, to ensure the reliability and performance of the cascade is problematic.

Further, the inner extraction slit 24 that extracts the turbine rotor cooling air 16 is disposed on an inner peripheral side of the compressor upstream of the last-stage stator vane (stator vane I). When a large amount of extracted air is extracted from the inner extraction slit 24, the axial velocity at the inner side of the stator vane I is reduced by extraction. For that reason, there is a possibility that the inlet flow angle is increased at the inner peripheral side of the stator vane I, stall occurs on the suction surface of the blade, and the flow is largely separated. In the cantilever stator vanes fitted to the casing as indicated by the stator vane I of FIG. 3, when separation particularly occurs on the inner peripheral side, the cascade is subjected to fluid excitation, resulting in a risk that the cascade is damaged by fluid vibration such as buffeting or stall flutter.

FIG. 5 is a cross-sectional view of the stator vane I prioritizing the efficiency in the span direction, and an inlet flow angle to total pressure loss characteristic curve 41 of air flowing in the vane. A problem on an increase in the blade loading of the stator vane I will be described with reference to FIG. 5.

The stator vane I is designed so that an operating region 43 from a choke side $\beta_o$ to a stall side $\beta_s$ can be sufficiently ensured in various operating ranges from start to full-load where the performance is maximum at the inlet flow angle $\beta_d$ of the gas turbine rated operation. The flow of air flowing into the stator vane I at the inlet flow angle $\beta_d$ is decelerated along the suction surface of the blade, and introduced to the stator vane II.

However, the inlet flow angle to the stator vane I becomes large due to the partial load operation of the gas turbine, the operation at a low atmospheric temperature, an increase in the amount of inner extracted air, and an increase in the pressure ratio. In the flow of air flowing into the stator vane I at a limit inlet flow angle $\beta_s$ or larger at the stall side, an incidence angle of the stator vane I becomes larger, and the flow is separated on the suction surface of the blade, and therefore the stator vane I is stalled. Because this separation phenomenon adversely affects the performance and the reliability of the cascade, there is a need to enlarge the operating region 43 of the stator vane I for the purpose of suppressing the separation on the vane surface. For that reason, it is important to appropriately distribute the blade loading from the stator vane I to the stator vane III.

Figure 1B:
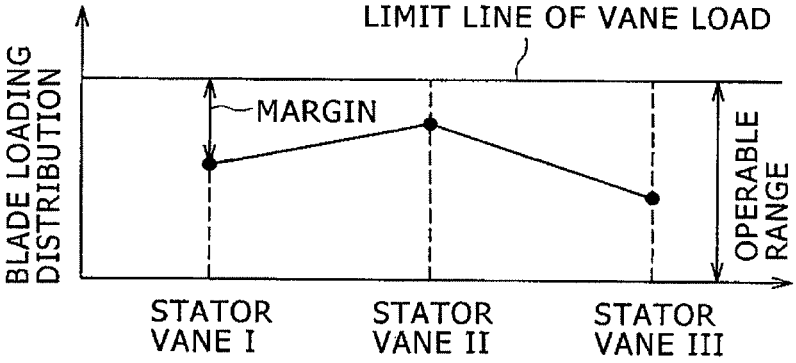
FIG. 1B is a distribution diagram of a blade loading of a rear-stage stator vane according to an embodiment of the present invention.

FIG. 1B illustrates a distribution of the blade loading from the stator vane I to the stator vane III according to this embodiment. One difference between FIGS. 1A and 1B resides in that the load on the stator vane I is set to be smaller than the load of the stator vane II. Also, another difference resides in that the load on the stator vane III is set to be smaller than the load of the stator vane I.

Figure 6:
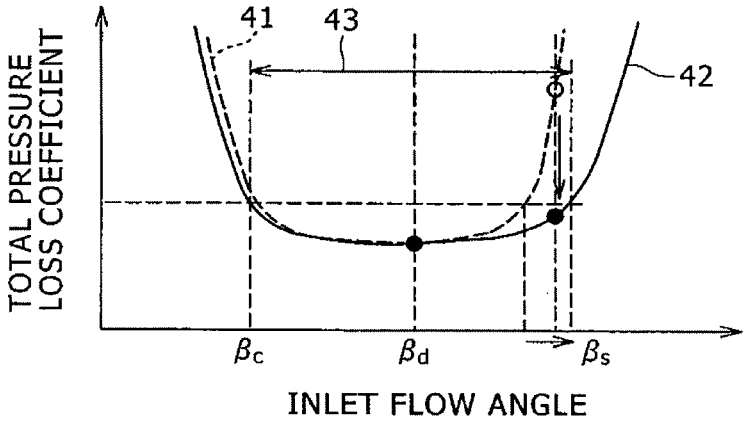
FIG. 6 is a diagram of an inlet flow angle to total pressure loss characteristic of the last-stage stator vane according to the embodiment.

The results of setting the load on the stator vane I to be smaller according to this embodiment will be described with reference to FIG. 6. FIG. 6 is a diagram of an inlet flow angle to total pressure loss characteristic of the air flowing in the stator vane I, and a characteristic curve 41 of a dotted line is identical with that in FIG. 5. When the blade loading on the stator vane I is reduced, the choke limit and the stall limit to the inlet flow angle can be increased as indicated by the inlet flow angle to total pressure loss characteristic curve 42. In particular, the inlet flow angle $\beta_s$ of the limit at the stall side can be enlarged, and the operating region 43 of the cascade can be enlarged. Further, the loss can be reduced as compared with the loss before the blade loading on the stator vane I is reduced, and the higher efficiency can be performed.

As described above, when the blade loading on the stator vane I is reduce to enlarge the operating region, the cascade can be operated with the blade loading of the limit line or lower even under the operating condition where there occurs the flow that causes the stator vane I to be adversely affected before the blade loading is reduced. That is, when the incidence angle of the stator vane I is set to the incidence limit or lower, the separation on the suction surface of the blade can be suppressed, and the reliability of the stator vane I can be improved.

In the load distribution illustrated in FIG. 1B, the load on the stator vane II increases according to the reduced amount of load on the stator vane I. However, because the stator vane I is disposed upstream of the stator vane II, an influence of the increase in the inlet, flow angle due to a change in the operating state is smaller than that in the stator vane I, and there is no increase in the local incidence caused by the inner extraction. Therefore, the inlet flow angle is stable. Also, since there is the stator vane III at the downstream side, the separation on the vane surface of the stator vane II does not directly influence the diffuser. For that reason, with application of the load distribution of FIG. 1B, both of the gas turbine performance and the reliability of the stator vane can be performed.

Also, the load on the stator vane III is not changed from FIG. 1A. When the load on the stator vane I is decreased, and the reduced amount of load is distributed even in the stator vane III, there is a possibility that the flow is separated from the suction surface of the blade with an increase in the load of the stator vane III. The stagger angle of the stator vane III is set to the axial direction in order to set the outlet flow angle to zero. For that reason, as the inlet flow angle is larger, the separation on the vane surface is more liable to occur in the stator vane III as compared with that of the stator vane I or the stator vane II. The separation on the stator vane III not only suffers from a problem on, the reliability of the vane, but also leads to deterioration of the diffuser performance since the separated flow flows into the diffuser at the downstream side. Further, the deterioration of the diffuser performance leads to an increase in the pressure loss of the combustor, resulting in a risk that the gas turbine performance is largely deteriorated. Therefore, it is desirable that the load on the stator vane III is not increased.

Specific examples of the load reduction ratio of the stator vane I illustrated in FIGS. 1A and 1B will be described with the use of the ratio of the load distribution from the stator vane I to the stator vane III.

With reference to the blade loading on the stator vane III, the load on the stator vane I is set to 1.0 to 1.3 times, and the load on the stator vane II is set to 1.3 to 1.6 times whereby the operating region of the stator vane I can be enlarged, and the reliability of the cascade can be ensured. When the load on the stator vane I is too decreased, there is a possibility that the load on the stator vane II is conversely increased, and the flow is separated from the vane surface of the stator vane II. When the serration is too larger, there is a risk that the separation occurs on the vane negative pressure surface of the stator vane III. Accordingly, it is desirable that the load increase of the stator vane II falls within a range of 1.3 to 1.6 times as large as the load of the stator vane III, and the load is set so that large separation does not occur on the stator vane II.

Figure 8:
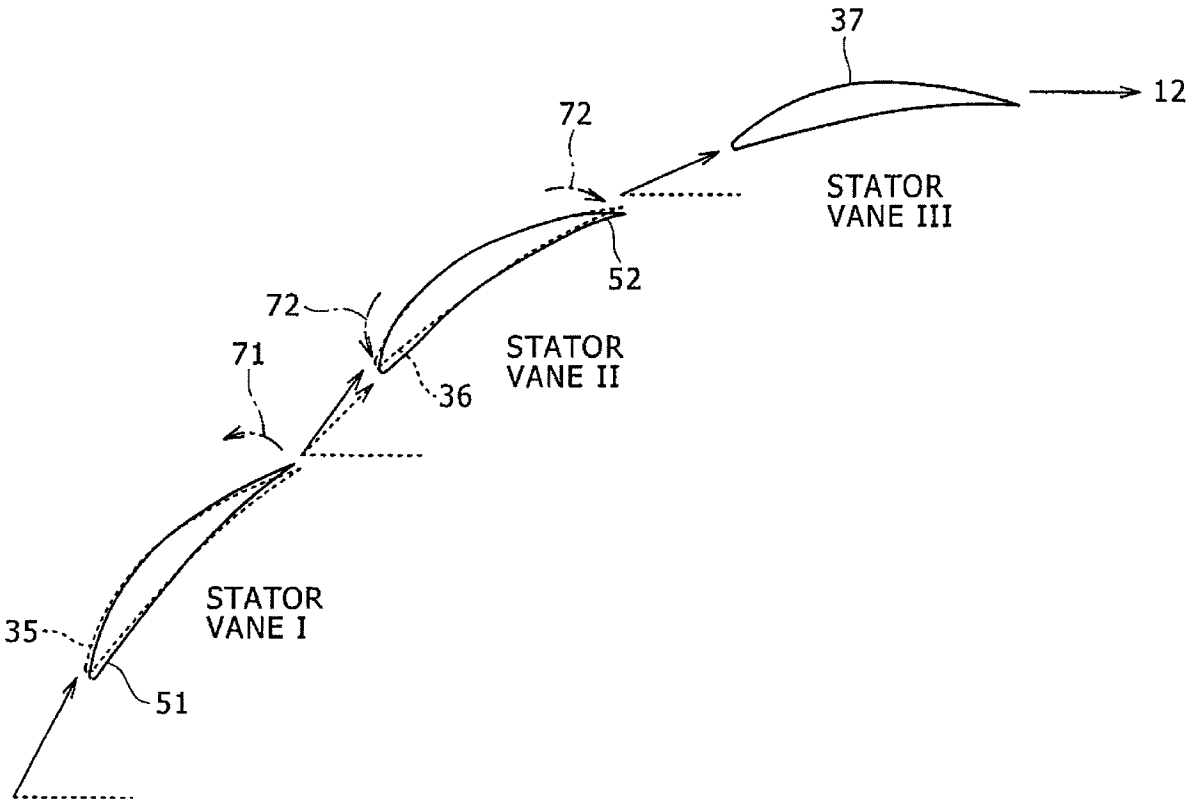
FIG. 8 is a cross-sectional view of the rear-stage stator vane according to the embodiment of the present invention in the span direction.

Subsequently, one example of a method of reducing the blade loading will be described with reference to FIG. 8. FIG. 8 is a cross-sectional view from the stator vane I to the stator vane III in the span direction. As usual, taking the operating region of the gas turbine into consideration, the compressor cascade is so designed as to ensure the wide operating range. However, with execution of specific operation, there is a possibility that the inlet flow angle of the stator vane I becomes large, and the incidence of the air to the stator vane I is increased. In this case, there is a need to reduce the blade loading in order to ensure the reliability of the stator vane I. In FIG. 8, the stator vanes 35 and 36 before modifying are indicated by dotted lines, and the stator vanes 51 and 52 after modifying are indicated by solid lines.

The stator vane I is rotated 71 so that the stagger angle become large about the center of gravity of the vane. With the rotation 71 of the vane, the inlet flow angle of the stator vane I is held constant according to the operating state where as the outlet flow angle can be increased. For that reason, the turning angle can be reduced, and the blade loading on the stator vane I can be reduced. Also, the stator vane I is rotated 71 to increase the stagger angle whereby the incidence angle of the air to the stator vane I is reduced. For that reason, the operating region at the stall side can be enlarged, and the separation on the suction surface of the blade can be suppressed.

However, when the stagger angle of the stator vane I is increased, the outlet flow angle is increased, and the inlet flow angle of the stator vane II becomes large. For the increase in the inlet flow angle, when the stagger angle of the stator vane II is changed as with the stator vane I, the inlet flow angle to the stator vane III becomes large as a result of which the blade loading on the stator vane III is increased. However, as described above, the stator vane III needs to set the outlet flow angle to zero, and it is desirable that the cascade load is also small.

Under the circumstances, the stator vane II bends a leading edge and a trailing edge toward the pressure surface side to increase a 72 camber angle. With such bending, the turning angle in the stator vane II can be increased. That is, an increase in the incidence angle of the stator vane II caused by an increase in the inlet flow angle can be reduced, and a constant outlet flow angle can be kept. With this vane shape, the incidence angle can be appropriately kept with respect to an increase in the inlet flow angle to the stator vane II. Further, a decrease of the turning angle in the stator vane I is compensated with an increase in the turning angle of the stator vane II, thereby enabling the constant outlet flow angle of the stator vane II to be kept. This does not adversely affect the stator vane III and the diffuser.

Figure 9:
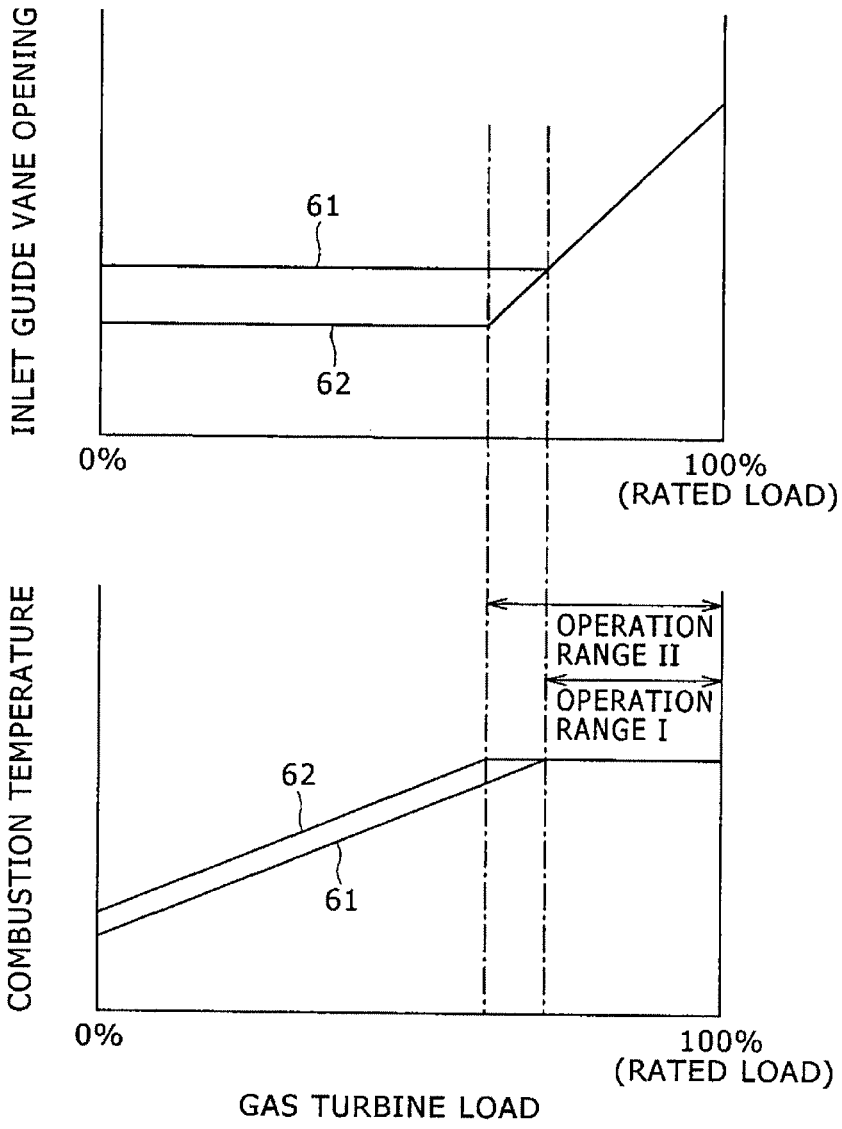
FIG. 9 is a diagram of a magnification effect of a gas turbine operation range according to the embodiment of the present invention.

The effects of the gas turbine on the operating range by the modifying illustrated in FIG. 8 will be described with reference to FIG. 9. FIG. 9 illustrates an example of the gas turbine showing the characteristics of an IGV opening change and the combustion temperature to the gas turbine load. Also, with a change of the IGV opening, a region in which the output can be changed with a constant combustion temperature is set as an operating range of the gas turbine.

Before modifying, when the IGV is being closed with the constant combustion temperature, the cascade load at the compressor rear stage side is increased with a given IGV opening 61, and particularly when the cascade load reaches a load limit line in the stator vane I, the load is a limit of the low load side. In FIG. 9, the load is indicated by an operating load I. In this example, with modifying as illustrated in FIG. 8, because the margin is expanded up to the load limit line of the stator vane I, a limit 62 for closing the IGV can be also enlarged. For that reason, the operating range of the gas turbine can be also enlarged from the operating load I to the operating load II.

Subsequently, a case in which three or more of the stator vanes exist will be described with reference to FIG. 11. FIG. 11 illustrates a load distribution of each, stator vane when four stator vanes are disposed downstream of the last-stage rotor blade.

Figure 11A:
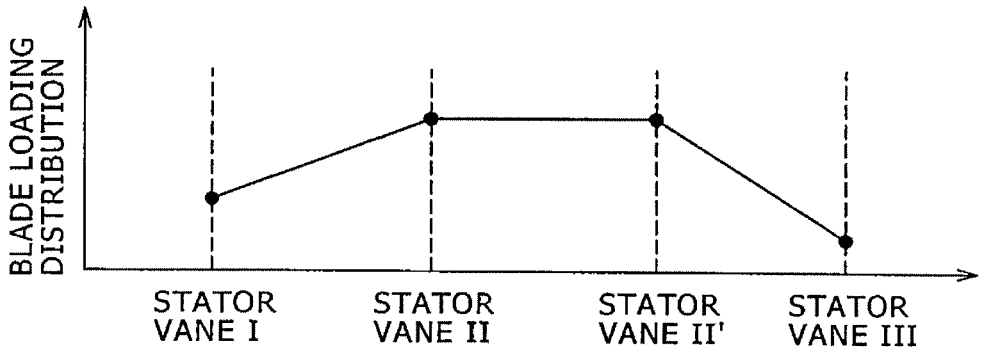
FIG. 11A is a distribution diagram of another blade loading of the rear-stage stator vane according to the embodiment of the present invention.
Figure 11B:
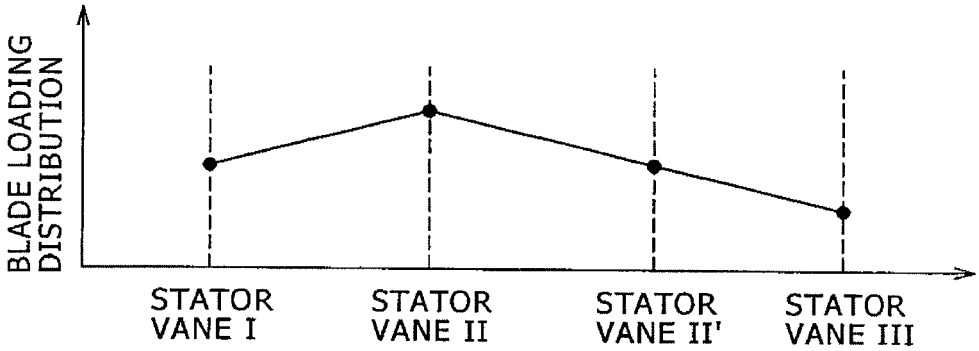
FIG. 11B is a distribution diagram of still another blade loading of the rear-stage stator vane according to the embodiment of the present invention.

In FIGS. 11A and 11B, as with a case in which three stator vanes are provided, the blade loading on the stator vane I disposed at the most upstream side in the stator vanes disposed downstream of the last-stage rotor blade is set to be smaller than the blade loading on the stator vane II disposed downstream of the stator vane I by one row. Similarly, the blade loading on the stator vane III disposed at the most downstream side is set to be smaller than the blade loading of the stator vane I.

A difference between FIG. 11A and FIG. 11B resides in setting of the blade loading of a stator vane II' disposed between the stator vane II and the stator vane III. When the load is set as illustrated in FIG. 11A, the load can be largely shared with the stator vane II as well as the stator vane II'. For that reason, the blade loading on the stator vane I can be further set to a smaller value, thereby enabling the reliability of the axial flow compressor to be more improved.

Also, when the load is set as illustrated in FIG. 11A, the load on the stator vane I can be reduced with a large load shared with the stator vane II, thereby enabling the reliability to be improved. Also, the blade loading on the stator vane II' is set such that the blade loading is decreased from the stator vane II toward the stator vane III with the result that the turbulent swirl flow into the diffuser can be suppressed. For that reason, the aerodynamic performance can be excellently held, and the high efficiency can be achieved.

Thus, with application of the above-mentioned load distribution, the blade loading on the last-stage stator vane can be prevented from reaching the limit line with respect to the increase in the load on the stator vane at the rear stage side of the compressor in the operation in which the IGV is closed such as the partial load operation of the one-shaft and two-shaft gas turbines. Therefore, the reliability of the cascade can be improved. As a result, the axial flow compressor that improves the reliability can be provided. Also, even when the inner extraction slit that extracts the turbine rotor cooling air exists upstream of the last-stage stator vane, the reliability can be improved.

The variation of the IGV opening can be enlarged with the use of the margin up to the limit line of the blade loading increased by appropriately distributing the load to the stator vanes at the compressor rear-stage side. Accordingly, the compressor inlet flow rate can be more widely controlled, and the operating range in the partial load of the gas turbine can be enlarged. Likewise, the amount of extracted air can be increased from the inner extraction slit.

Except for the gas turbine axial flow compressor, the present invention is applicable to an industrial axial flow compressor.

Figure 7:
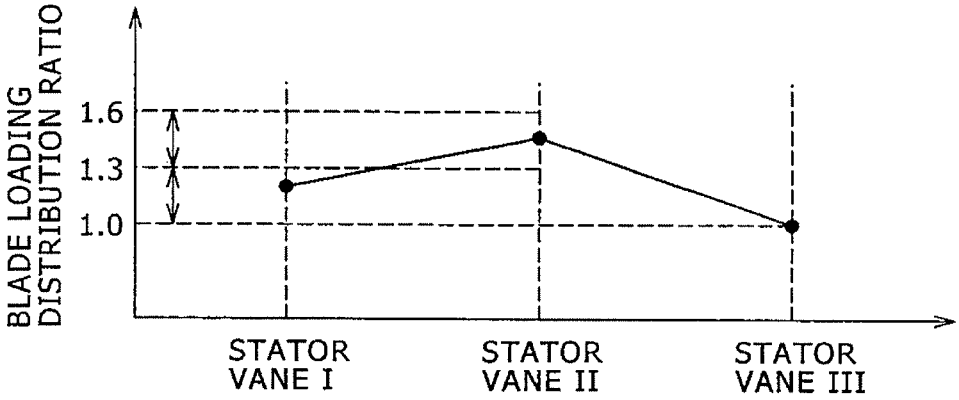
FIG. 7 is a diagram of a blade loading distribution ratio of a rear-stage stator vane according to the embodiment of the present invention.

FIG. 1A
BLADE LOADING DISTRIBUTION
MARGIN
LIMIT LINE OF BLADE LOADING.
OPERABLE RANGE
STATOR VANE I
STATOR VANE II
STATOR VANE III
FIG. 1B
BLADE LOADING DISTRIBUTION
MARGIN
LIMIT LINE OF BLADE LOADING
OPERABLE RANGE
STATOR VANE I
STATOR VANE II
STATOR VANE III
FIG. 2
FIG. 3
FIG. 4
STATOR VANE I
STATOR VANE II
STATOR VANE III
AXIAL DIRECTION
FIG. 5
TOTAL PRESSURE LOSS COEFFICIENT
INLET FLOW ANGLE
SEPARATION
NEGATIVE PRESSURE SURFACE
PRESSURE SURFACE
FIG. 6
TOTAL PRESSURE LOSS COEFFICIENT
INLET FLOW ANGLE
FIG. 7
BLADE LOADING DISTRIBUTION RATIO
STATOR VANE I
STATOR VANE II
STATOR VANE III
FIG. 8
STATOR VANE I
STATOR VANE II
STATOR VANE III

FIG. 9
INLET GUIDE VANE OPENING
RATED LOAD
COMBUSTION TEMPERATURE
OPERATING LOAD II
OPERATING LOAD I
GAS TURBINE LOAD
RATED LOAD
FIG. 10
FIG. 11A
BLADE LOADING DISTRIBUTION
STATOR VANE I
STATOR VANE II
STATOR VANE II'
STATOR VANE III
FIG. 11B
BLADE LOADING DISTRIBUTION
STATOR VANE I
STATOR VANE II
STATOR VANE II'
STATOR VANE III

What is claimed is:

1. An axial flow compressor comprising:

an annular flow passage that is formed by a rotor having a plurality of rotor blades fitted thereto; and a casing having a plurality of stator vanes fitted thereto, wherein two or more of the stator vanes are disposed downstream of a last-stage rotor blade of the annular flow passage, the two or more stator vanes being fixed stator vanes without angle variable mechanisms, and a blade loading on a first stator vane disposed at the most upstream side among the two or more stator vanes is set to be smaller than a blade loading of a second stator vane disposed downstream of the first stator vane by one row.

2. The axial flow compressor according to claim 1, wherein three or more of the stator vanes are disposed downstream of the last-stage rotor blade, and a blade loading on a third stator vane disposed at the most downstream side in a flow direction of the annular flow passage is set to be smaller than a blade loading of the first stator vane.

3. The axial flow compressor according to claim 2, wherein the blade loading on the first stator vane is set to be equal to or lower than 1.3 times as large as the blade loading on the third stator vane, and the blade loading on the second stator vane is set to be larger than the blade loading on the first stator vane, and to be 1.3 to 1.6 times as large as the blade loading on the third stator vane.

4. The axial flow compressor according to claim 2, wherein there is provided an inner extraction slit that extracts a compressed air from between the last-stage rotor vane and the first stator vane.

5. A gas turbine system, comprising:

a combustor that mixes a compressed air with a fuel, burns the mixture, and generates a combustion gas;

a turbine rotated by the combustion gas; and an axial flow compressor and a load device which are driven by a rotating power of the turbine, wherein three or more stator vanes are disposed downstream of a last-stage rotor blade of the axial flow compressor, the stator vanes being fixed stator vanes without angle variable mechanisms, a blade loading on a first stator vane disposed at the most upstream side among the stator vanes is set to be larger than a blade loading of a third stator vane disposed at the most downstream side, and a blade loading on a second stator vane disposed downstream of the first stator vane by one row is set to be larger than the blade loading on the first stator vane.

6. The gas turbine system according to claim 5, wherein the turbine includes a high pressure turbine and a low pressure turbine each having a different shaft.

7. A method of distributing a load to stator vanes disposed downstream of a last-stage rotor blade in an axial flow compressor in which, an annular flow passage is formed by a rotor having multiple of rotor blades fitted thereto and a casing having multiple of stator vanes fitted thereto, and three or, more stator vanes are disposed downstream of the last-stage rotor blade of the annular flow passage, wherein a blade loading on a first stator vane disposed downstream of the last-stage rotor blade by one vane row is set to be equal to or lower than 1.3 times as large as a blade loading on a third stator vane disposed at the most downstream side, and a blade loading on a second stator vane is set to be larger than the blade loading on the first stator vane, and to be 1.3 to 1.6 times as large as the blade loading on the third stator vane.

8. A method of modifying a stator vane in an axial flow compressor having two or more stator vanes downstream of a last-stage rotor blade disposed at the most downstream side in a flow direction of an operating fluid, the method comprising the steps of:

rotating a first stator vane disposed at the most upstream side among the stator vanes about a center of gravity of the vanes so as to increase a stagger angle; and bending a blade leading edge and a blade trailing edge of a second stator vane disposed downstream of the first stator vane by one vane row toward a pressure surface side to increase a camber angle.

9. The method of modifying a stator vane according to claim 8, wherein a decrease of a turning angle of an operating fluid in the first stator vane by rotating the first stator vane so as to increase a stagger angle of the first stator vane is made equal to an increase of the turning angle by increasing the camber angle by bending the blade leading edge and the blade trailing edge of the second stator vane toward a pressure surface side to increase the camber angle.

* * * * *